US005785487A

United States Patent [19]

McNeilus et al.

[11] Patent Number: 5,785,487

[45] Date of Patent: Jul. 28, 1998

[54] PUSH OUT EJECTION SYSTEMS FOR REFUSE TRUCK

[75] Inventors: Garwin B. McNeilus, Dodge Center, Minn.; Ronald E. Christenson, Parsons, Tenn.; Wilbur R. Harris, Rochester; Francis Oliver, Kasson, both of Minn.

[73] Assignee: McNeilus Truck and Manufacturing, Inc., Dodge Center, Minn.

[21] Appl. No.: 788,212

[22] Filed: Jan. 27, 1997

[51] Int. Cl.[6] ..... B65F 3/28

[52] U.S. Cl. ..... 414/517; 414/525.6; 100/218

[58] Field of Search ..... 414/509, 510, 414/511, 512, 513, 517, 518, 408, 409, 406, 407, 525.1, 525.6; 100/218, 215, 216

[56] References Cited

U.S. PATENT DOCUMENTS

| | | | |
|---|---|---|---|
| 3,653,271 | 4/1972 | Worthington . | |
| 3,901,394 | 8/1975 | Bowles . | |
| 4,041,799 | 8/1977 | Teti | 414/517 X |
| 4,544,320 | 10/1985 | Haines | 414/517 X |
| 4,576,540 | 3/1986 | Derain et al. | 414/517 X |
| 4,715,767 | 12/1987 | Edelhoff et al. . | |
| 4,877,366 | 10/1989 | De Filippi | 414/517 |
| 4,954,020 | 9/1990 | Smith et al. . | |
| 5,064,332 | 11/1991 | Gdelhoff et al. | 414/517 X |
| 5,074,737 | 12/1991 | Pellegrini et al. . | |

FOREIGN PATENT DOCUMENTS

| | | | |
|---|---|---|---|
| 2506732 | 12/1982 | France | 414/525.6 |
| 474968 | 4/1929 | Germany | 414/525.6 |
| 1562240 | 5/1990 | U.S.S.R. | 414/517 |

*Primary Examiner*—Frank E. Werner
*Attorney, Agent, or Firm*—Haugen and Nikolai, P.A.

[57] ABSTRACT

A compound packing and ejecting device for a front or slide loading refuse vehicle for packing refuse from a charging hopper into an associated storage body and later ejecting the refuse from a rearward portion of the storage body without tilting the storage body. A loading device may be used to load refuse or recyclables from the front or side of the vehicle into the charging hopper. A plurality of compound packing and ejecting devices may be mounted within the charging hopper. The packing and ejecting device includes packing cylinders and ejecting cylinders coupled to a packer panel, wherein the expansion of the packing cylinders, with the ejecting cylinders retracted, linearly displaces the packer panel through a first longitudinal portion of the storage body and expansion of the ejecting cylinders, together with expansion of the packing cylinders, displaces the packer panel through the remainder of the storage body.

9 Claims, 11 Drawing Sheets

PUSH OUT EJECTION SYSTEMS FOR REFUSE TRUCK

BACKGROUND OF THE INVENTION

I. Field of the Invention

The present invention relates generally to refuse vehicles, particularly any front loading, rear discharging vehicle body dedicated to hauling refuse and recyclables, and more specifically relates to a new compound extending, packing, and ejecting mechanism disposed within such a vehicle for packing refuse or recyclables from a charging hopper into an associated storage body and later fully ejecting the same from the storage body without tilting a portion of the storage body.

II. Related Art

Refuse hauling trucks commonly include a heavy-duty chassis and a hollow truck body mounted on the chassis and dedicated to receiving, compacting and discharging refuse materials. This combination generally includes all the associated hydraulic, pneumatic and/or electric operating mechanisms associated with heavy-duty packing and ejection equipment. Such trucks are typically loaded from the rear, front, or side and have a heavy hydraulic-operated compacting system to compact the refuse within a storage body of the truck.

In the case of front or side loading vehicles, refuse or recyclables are dumped into a top loading charging hopper rearward of both the vehicle cab and a packing blade disposed within the charging hopper. In one type of cylinder-operated packing blade, a hollow, relatively vertical blade is moved aft along a horizontal plane in the manner of a plow blade to pack and compress the refuse into the storage body after each loading. Between loadings, the packer blade is moved to a forward stowed position in the charging hopper, to allow more refuse to enter the charging hopper rearward of the blade. In this manner, refuse is eventually packed against a heavy-duty tailgate until the storage body is full. Once the storage body is full, the tailgate is opened and the storage body is tilted to dump the contents. A representative example of such a refuse vehicle appears in U.S. Pat. No. 4,715,767, issued to Edelhoff et al. which describes a front loading refuse vehicle that must be tilted to empty the refuse from the storage compartment of the vehicle.

U.S. Pat. No. 3,901,394 issued to Bowles discloses a packing ram for a self-contained refuse handling and transporting vehicle. The packing ram is positionable in either of a packing or ejecting position within the body of the vehicle. The packing ram includes a diagonally projecting cylinder aligned vertically within the charging hopper opening, wherein one end is attached to the packing ram and the other end is attached to an anchor block. The anchor block is slidable along upper side rails between a first packing position and a second ejecting position and includes pins or plungers which lock into either fore (packing) or aft (ejecting) holes. When the pins are engaged in the holes, the anchor block is locked into position. A cylinder is used to withdraw and disengage the pins from the holes. To move the anchor block between fore and aft positions, an inch worm type motion is required, extending the packing cylinder, unlocking the anchor block and retracting the packing cylinder.

While strides have been made, a need clearly persists for a packing apparatus that is operable in both a packing and fully ejecting mode that avoids potential jamming, thereby allowing refuse to be loaded from either the front or side while eliminating the need to tilt the storage body during the dump cycle, without significantly decreasing the holding capacity of the charging hopper. The present invention meets these needs.

SUMMARY OF THE INVENTION

The purpose of the present invention is to provide a combined, compound packing and ejecting mechanism for a front or side loading refuse vehicle having rearward discharge to thereby eliminate the need to tilt the storage body to empty the same. The packing and ejecting mechanism packs refuse from a charging hopper into an associated storage body and later ejects the refuse from the storage body. The packing and ejecting mechanism is generally disposed within the charging hopper of the vehicle and is operable between stowed and ejection positions. The packing and ejecting mechanism generally includes a packer panel, a pair of pivoting linkage members which combine and coordinate the packing and ejection positions of the packer panel in conjunction with a pair of packing cylinders and a pair of ejecting cylinders. When the packing and ejecting mechanism is in the fully retracted or stowed position, each of the pair of packing cylinders, the pair of ejecting cylinders and the pair of locking members are folded or collapsed in scissor fashion to form an X pattern, thereby reducing the amount of space in front of the charging hopper required to stow the packer panel.

The packer panel is positioned within the charging hopper and linearly displaceable rearward between stowed, packing and ejecting positions for respectively packing materials into the storage body and ejecting the materials from the storage body. The packer body slides along a track or guide system of known construction and includes a pair of packing cylinders pivotally attached thereto. The other end of each packing cylinder is pivotally attached to a corresponding linkage member. A follower panel is coupled between a forward end of the charging hopper and the packer panel, thereby allowing loading of refuse or recyclables into the charging hopper, when the packer panel is displaced within the storage body, without exposing the pairs of packing and ejecting cylinders and the area forward of the packer panel.

Each pivotally mounted linkage member has a free end and a fixed end, wherein a corresponding packing cylinder is attached to the free end. The fixed end of each linkage member is rotatably attached to a base member of the charging hopper. The base member is positioned in the forward end of the charging hopper at a location forward of the packer panel. The ejecting cylinder has a first end rotatably attached to the base member of the charging hopper and a second end rotatably attached to the linkage member. The point of attachment of the first end of the ejecting cylinder to the base member is offset a distance from the point of attachment of the linkage member to the base member to provide an amount of pivot leverage. The linkage members act as compound linkages between the corresponding packing cylinders and ejecting cylinders.

At the beginning of a cycle, the packer panel is usually positioned in its stowed position within a forward portion of the charging hopper, such that refuse may be loaded into the charging hopper above and rearward of the packer panel. Both the packing cylinders and the ejecting cylinders are retracted when the packer panel is in the stowed position. Periodically, the packing cylinders are extended, thereby linearly displacing the packer panel rearward through a first longitudinal portion of the storage body and pushing the charged refuse ahead of it into the storage body. The packing cylinders are then retracted to return the packer panel to its stowed position. During the packing cycle the ejecting cylinders remain in their collapsed or retracted position with the linkage members folded forward in the charging hopper.

In the dumping mode, the tailgate is opened and the packer panel is linearly displaced through a first longitudinal portion of the storage body by extended the packing cylinders. Then, the ejecting cylinders are extended, unfolding the linkage members, thereby further linearly displacing the packer panel rearward through the remainder of the storage body and thus forcing all of the refuse out the rearward opening ahead of the packer panel without the need to tilt the storage body.

OBJECTS

It is accordingly a principal object of the present invention to provide a device disposed in the charging or storage compartment of the refuse vehicle and operable for packing refuse into the storage compartment and later ejecting the refuse from the storage compartment.

Another object of the present invention is to provide a push out ejection system for refuse trucks that is operable as both a packer and an ejector without the need for telescoping cylinders or compromising the holding capacity of the charging hopper.

These and other objects, as well as these and other features and advantages of the present invention will become readily apparent to those skilled in the art from a review of the following detailed description of the preferred embodiment in conjunction with the accompanying claims and drawings in which like numerals in the several views refer to corresponding parts. The present invention represents a variety of improvements to the packing and ejection systems of refuse vehicles which can take the form in any of a great variety of embodiments. The detailed embodiments are intended as representative or exemplary of those in which the improvements of the invention may be incorporated and are not presented as being limiting in any manner.

DETAILED DESCRIPTION

The present invention represents improvements in the packing and ejecting mechanisms of refuse trucks that may reduce associated pickup, delivery, and maintenance costs. The present invention is directed to a mechanism that is operable both as a packer panel and as an ejector panel within the refuse vehicle.

Figure 1:
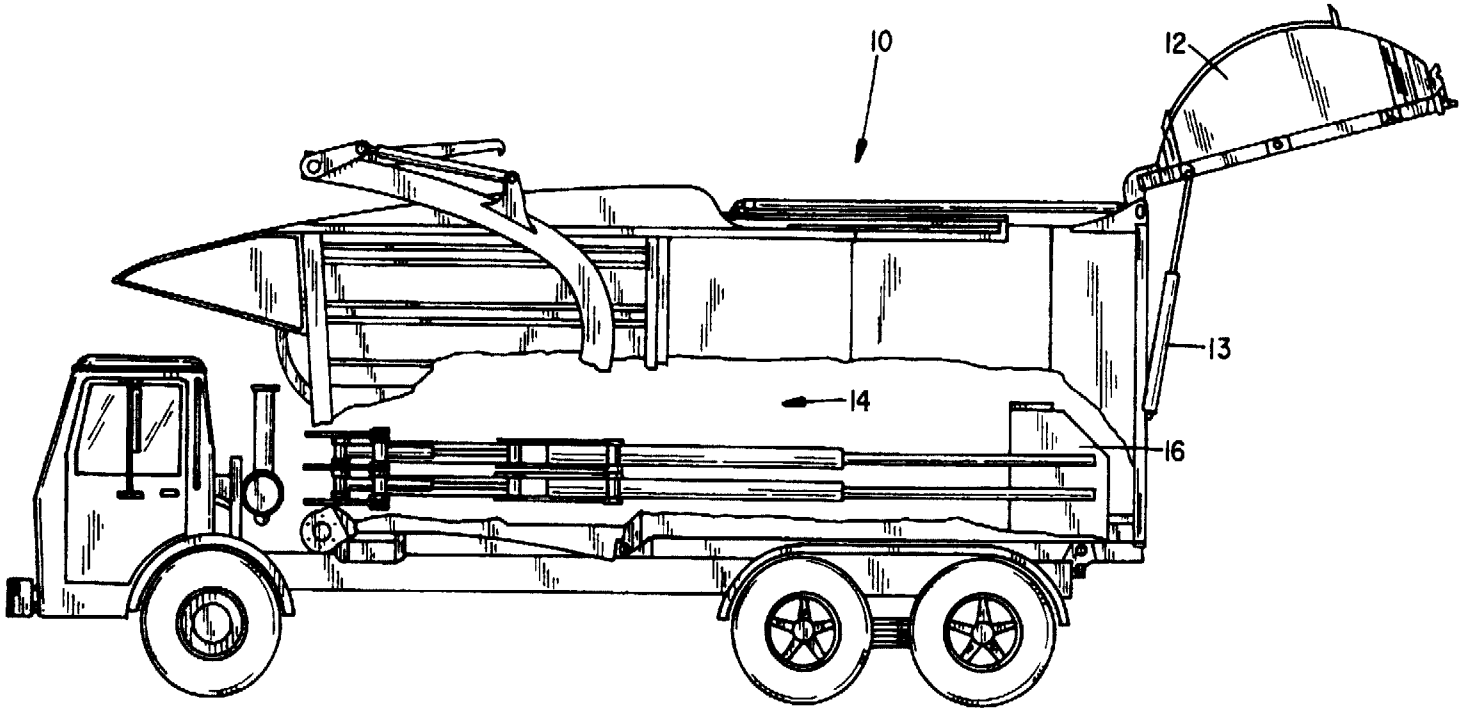
FIG. 1 is a side elevational view of front loading refuse vehicle having a portion of the charging hopper and storage body broken away and exposing the packer panel in its fully extended, ejecting position, with the follower panel removed.
Figure 2:
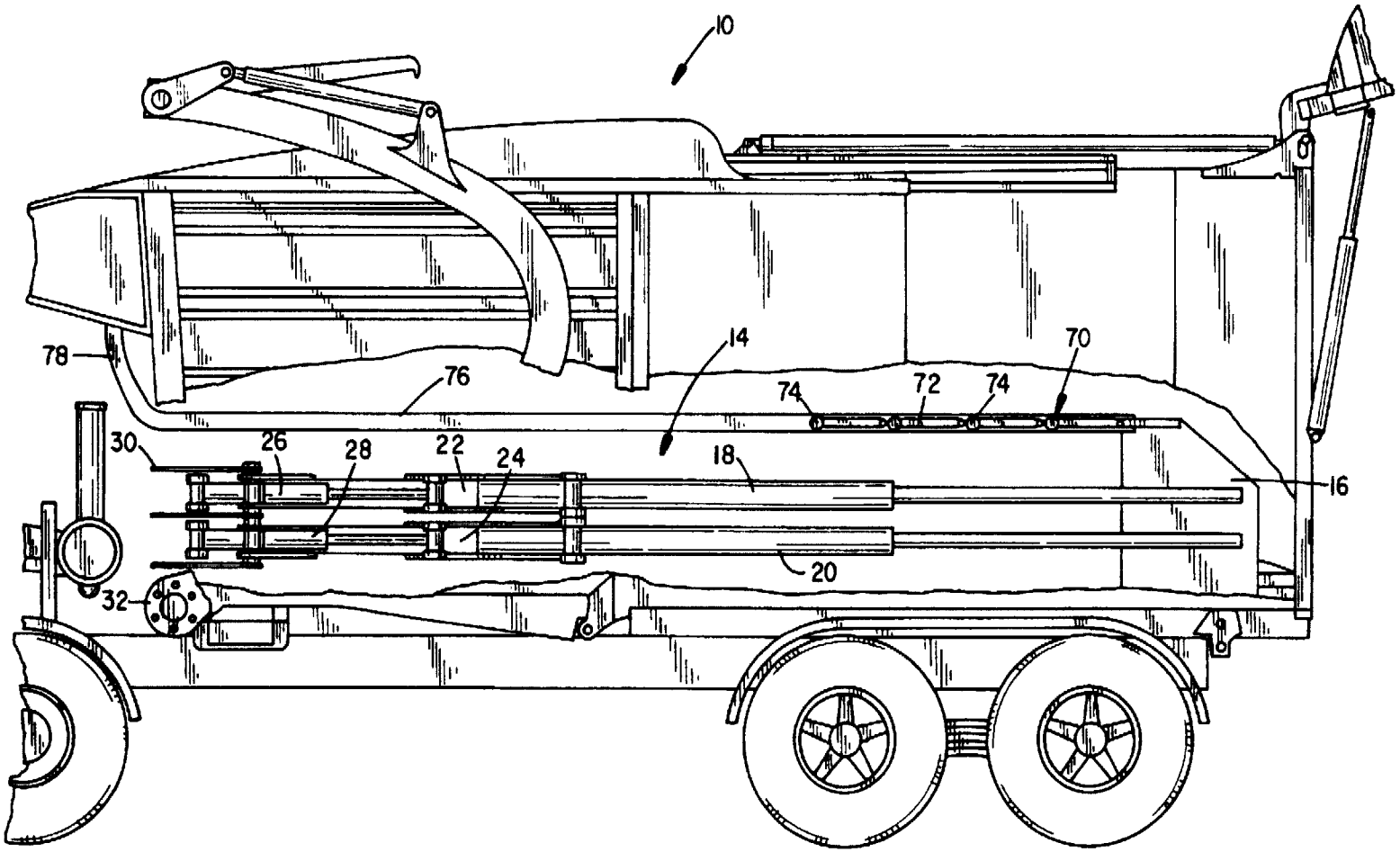
FIG. 2 is an enlarged fragmentary broken side elevational view of charging hopper and storage body of the type shown in FIG. 1.

As depicted in FIGS. 1 and 2, a refuse vehicle 10 of the front loading variety is shown with the tailgate 12 in the filly open (raised) position with cylinders as at 13 extended and the packing and ejecting mechanism 14 in the fully extended ejecting position. The packing and ejecting mechanism 14 generally includes a packer panel 16, a pair of packing cylinders 18 and 20, a pair of linkage members 22 and 24, a pair of ejecting cylinders 26 and 28, and a pair of base members 30 and 32. The packing and ejecting cylinders 18–24 are of the double acting fluid operated type of suitable known construction available from various manufacturers, the attachment of which is further described below.

Those skilled in the art will appreciate that a jointed follower panel 70 may be attached to the packer panel 16, thereby allowing refuse to be loaded in the charging hopper even when the packer panel 16 is linearly displaced rearward (see FIG. 2). One follower panel design is described in co-pending U.S. patent application Ser. No. 08/748,649 filed Nov. 14, 1996 and assigned to the same assignees as the present invention, the entire disclosure of which is incorporated herein by reference. In FIG. 2, the follower panel 70, which is attached at one end to the packer panel and has a free trailing end, generally comprises several panel segments 72 consecutively hinged together, supporting rollers 74 are attached to each end of each panel 72, and adapted to ride in a track or guide as at 76 attached to each of the sidewalls of the storage body 36 and charging hopper 34. As the packer panel 16 is displaced rearward, the follower panel 70 is pulled behind the packer panel. As the packer panel 16 is retracted to the stowed position, the follower panel 70 is pushed along the track 76 forward of the packer panel 16 partially extending into a curved storage portion of the guide at 78.

Figure 3:
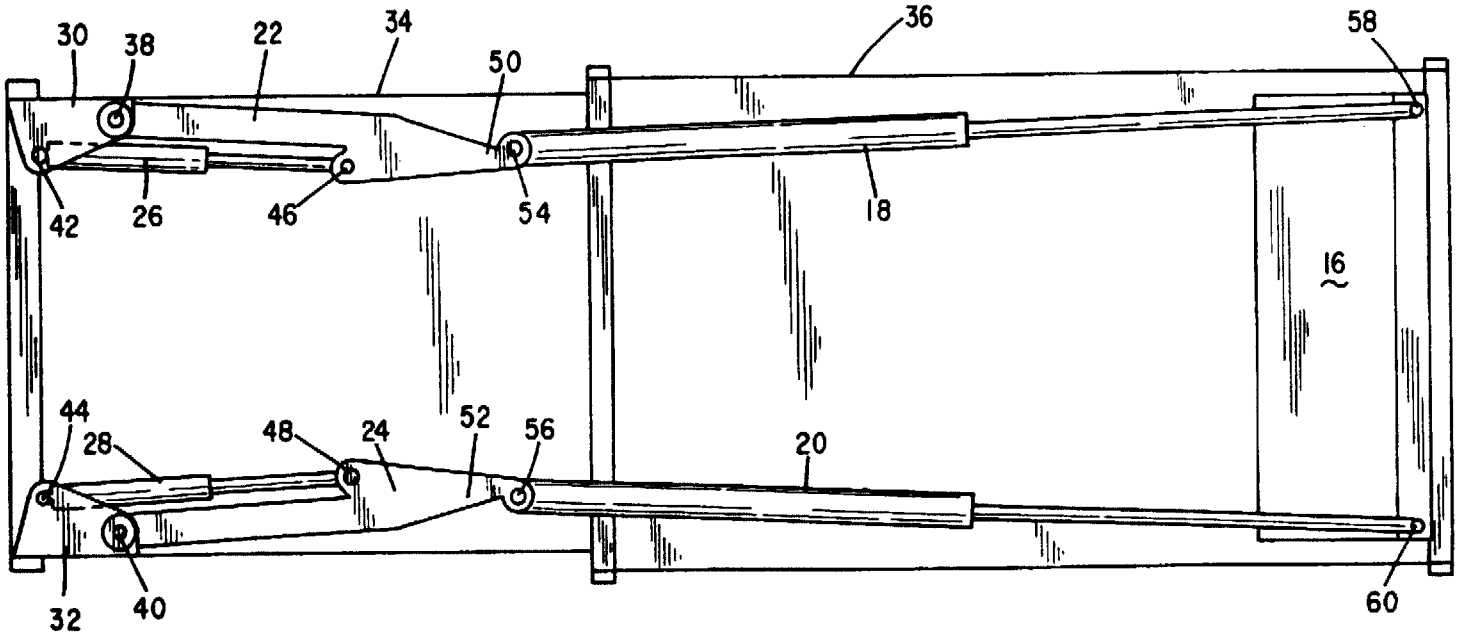
FIG. 3 is a top fragmentary plan view showing the packing and ejecting mechanism of the invention in its fully extended position.

FIG. 3 shows the alignment and positioning of a pair of packing and ejecting mechanisms 14 disposed in a refuse vehicle in their fully extended ejecting position. Each base member 30 and 32 is a heavy metal plate section shown attached to a forward corner portion of the charging hopper 34. Fixed ends 38 and 40 of respective linking members 22 and 24 and fixed ends 42 and 44 of ejecting cylinders 26 and 28 are rotatably attached to the corresponding base member 30 and 32. The points of attachment of the fixed ends 42 and 44 of ejecting cylinders 26 and 28 are offset a distance from the points of attachment of the fixed ends 38 and 40 of linkage members 22 and 24. Free ends 46 and 48 of ejecting cylinders 26 and 28 are rotatably attached proximate the free ends 50 and 52 of the respective linkage members 22 and 24. First ends 54 and 56 of respective packing cylinders 18 and 20 are also rotatably attached to the respective free ends 50 and 52 of respective linkage members 22 and 24. Second ends 58 and 60 of packing cylinders 18 and 20 are attached to the inside of the packer panel or blade 16. The linkage members 22 and 24 act as compound linkages between the corresponding packing cylinders 18 and 20 and ejecting cylinders 26 and 28.

Figure 4:
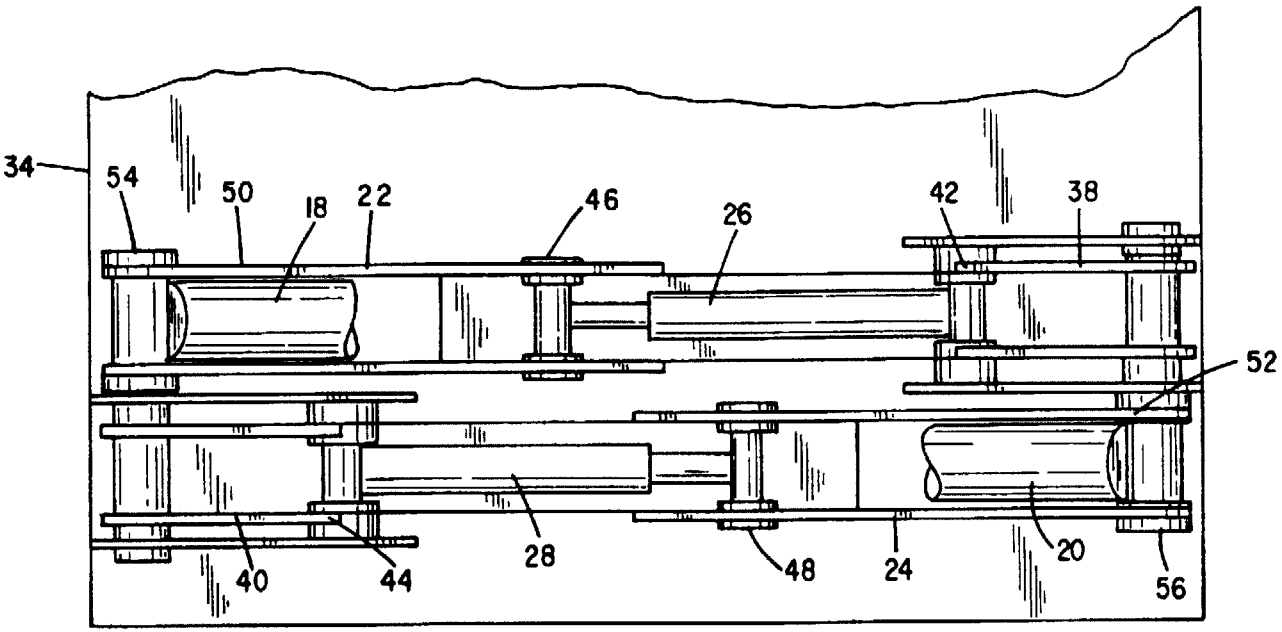
FIG. 4 is a magnified fragmentary front elevational view showing the packing cylinders, ejecting cylinders and linkage in a fully retracted or stowed position.
Figure 5:
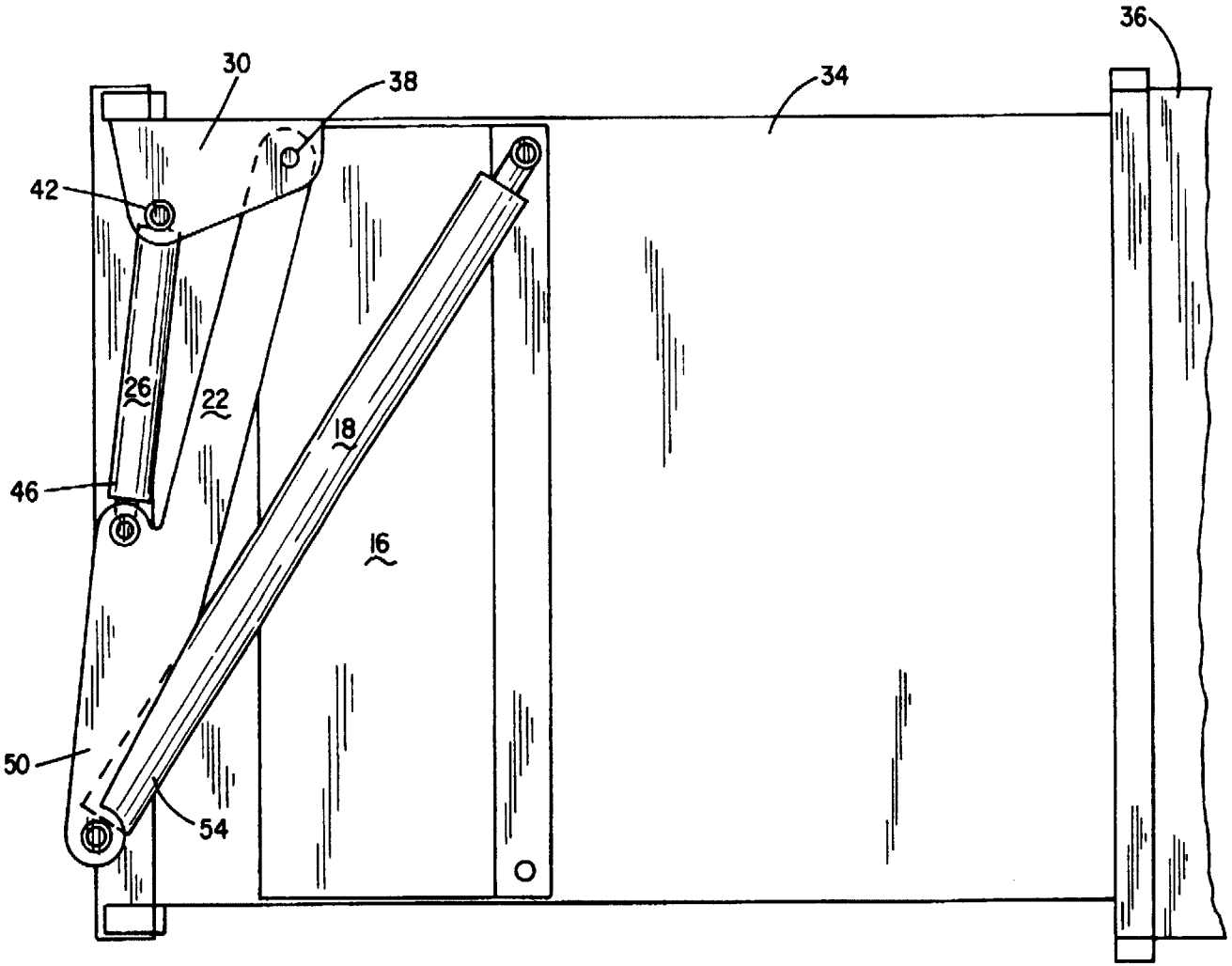
FIG. 5 is an enlarged top fragmentary plan view showing one of the packing and ejecting mechanisms in its fully retracted or stowed position.
Figure 6:
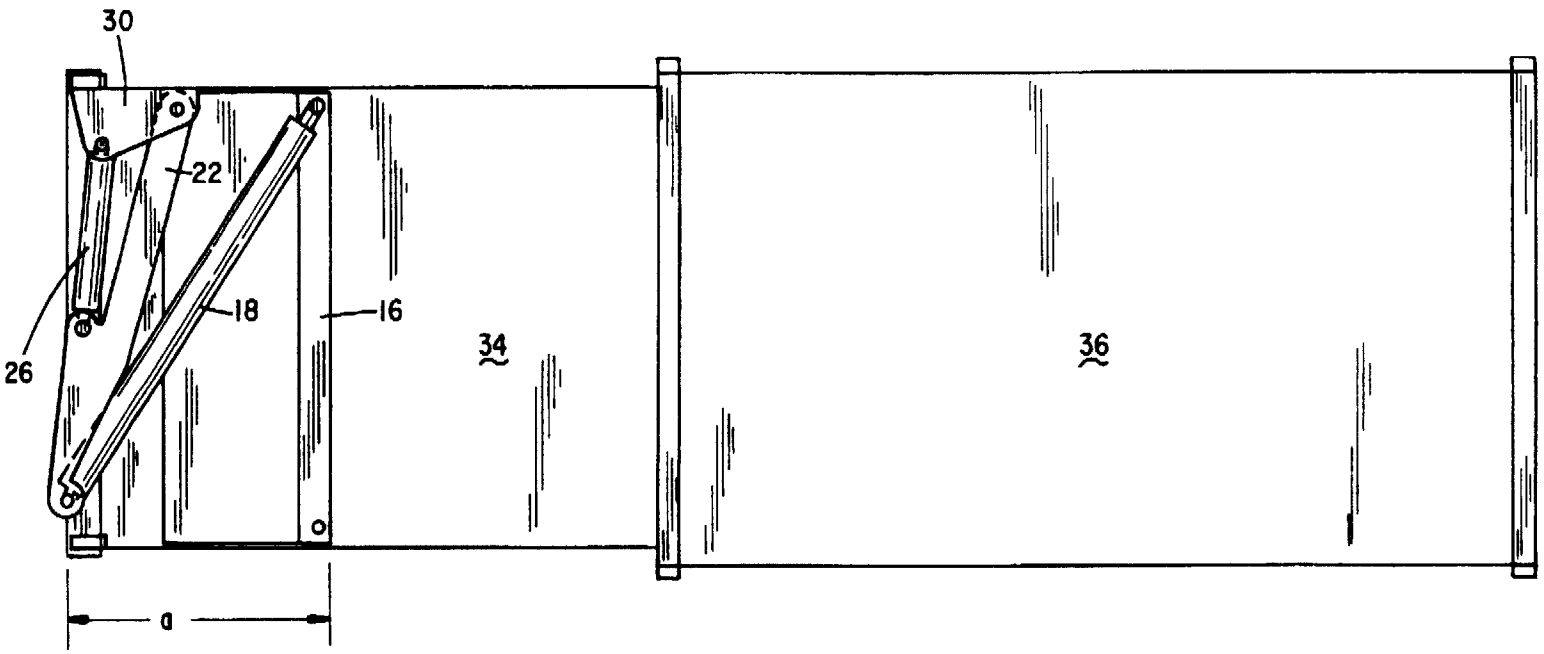
FIG. 6 is a top fragmentary plan view of one of the packing and ejecting mechanisms in its fully retracted position.

The packing and ejecting mechanisms 14 are positioned in vertically offset horizontal planes, such that in the stowed position the mechanisms 14 fold in a vertical arrangement above and below each other (see FIG. 4). In the stowed position, the longitudinal axis of the packing cylinders 18 and 20, the linkage members 22 and 28, and the linkage members 22 and 24 are all folded within the charging hopper 34 in a disposition relatively transverse to the longitudinal axis of the storage body 36.

With reference now to FIGS. 5–8, the displacement of the packing and ejecting mechanism will be described in further detail. FIGS. 5–8 show one of the pairs of packing and ejecting mechanisms 14 removed for clarity. Of course, the description of the packing and ejecting mechanism 14 equally applies to the one removed. In the stowed position (see FIGS. 5 and 6), both the packing cylinder 18 and the ejecting cylinder 26 are in the retracted position. The linking member 22 allows the cylinders 18 and 26 to be positioned substantially laterally within the charging hopper 34 when in the stowed position, thereby reducing the amount of space (a) required within the charging hopper 34 for stowage of the packing and ejecting mechanism 14.

Figure 7:
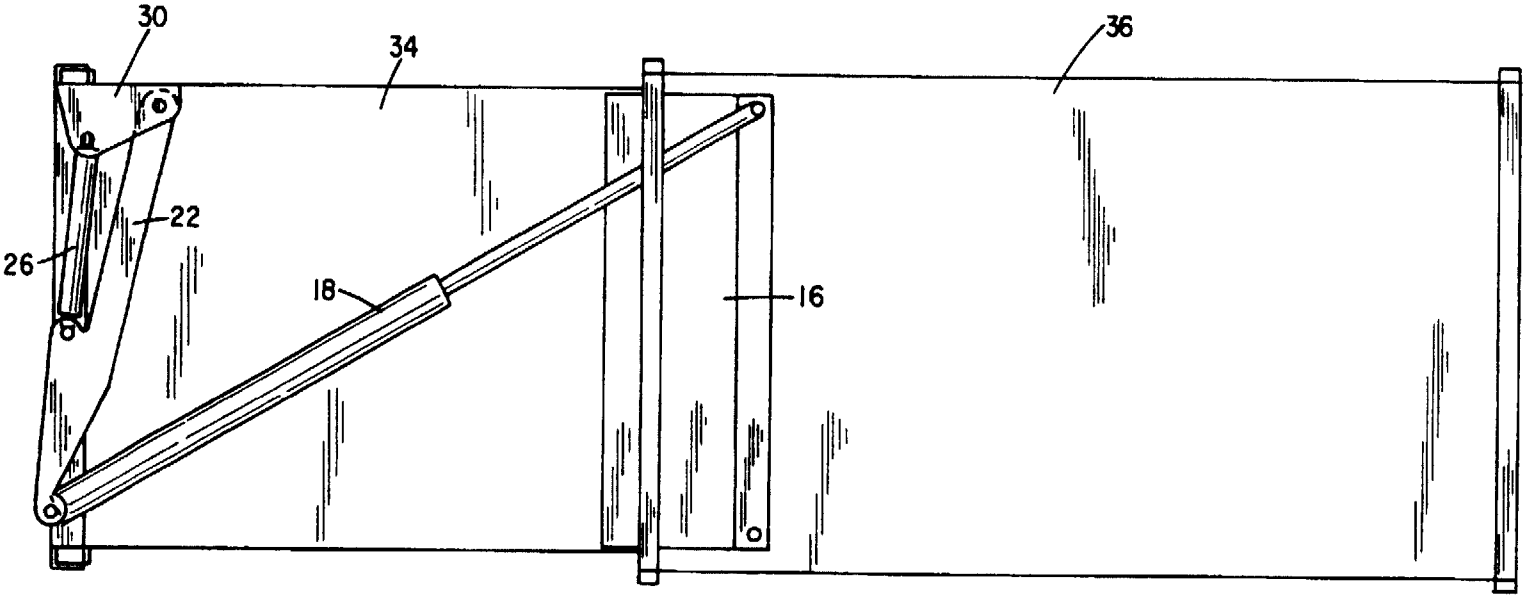
FIG. 7 is a top fragmentary plan view of one of the packing and ejecting mechanisms, wherein the packing cylinders are in their expanded (packing) position, the packer panel being displaced a short distance within the storage body.
Figure 8:
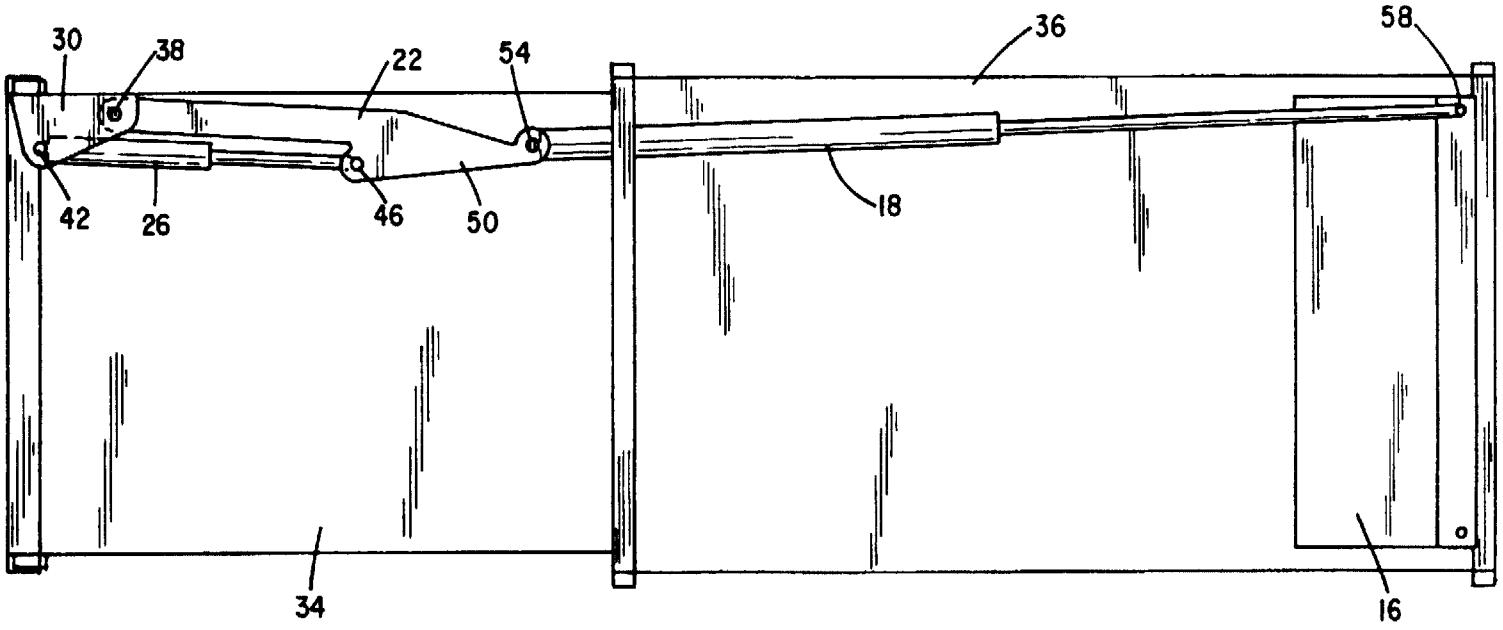
FIG. 8 is a top fragmentary plan view showing one of the packing cylinders and ejecting cylinders both in their expanded position, thus placing the packer panel in its load ejecting position.

As seen in FIG. 7, when the packing cylinder 18 is expanded, the packer panel 16 is linearly displaced rearward a short distance, typically about 2 feet, into the storage body 36 of the refuse vehicle. As the ejecting cylinder 26 is extended, the linkage member 22 pivots rearward, thereby further linearly displacing the packer panel 16 toward the rear of the storage body 36. When the ejecting cylinder 26 is fully expaned, the packer panel 16 is displaced fully to the rear of the storage body 36 (see FIG. 8). In order to return the packer panel 16 to the stowed position, the ejecting cylinders 26 and 28 and packing cylinders 18 and 20 are retracted.

Figure 9:
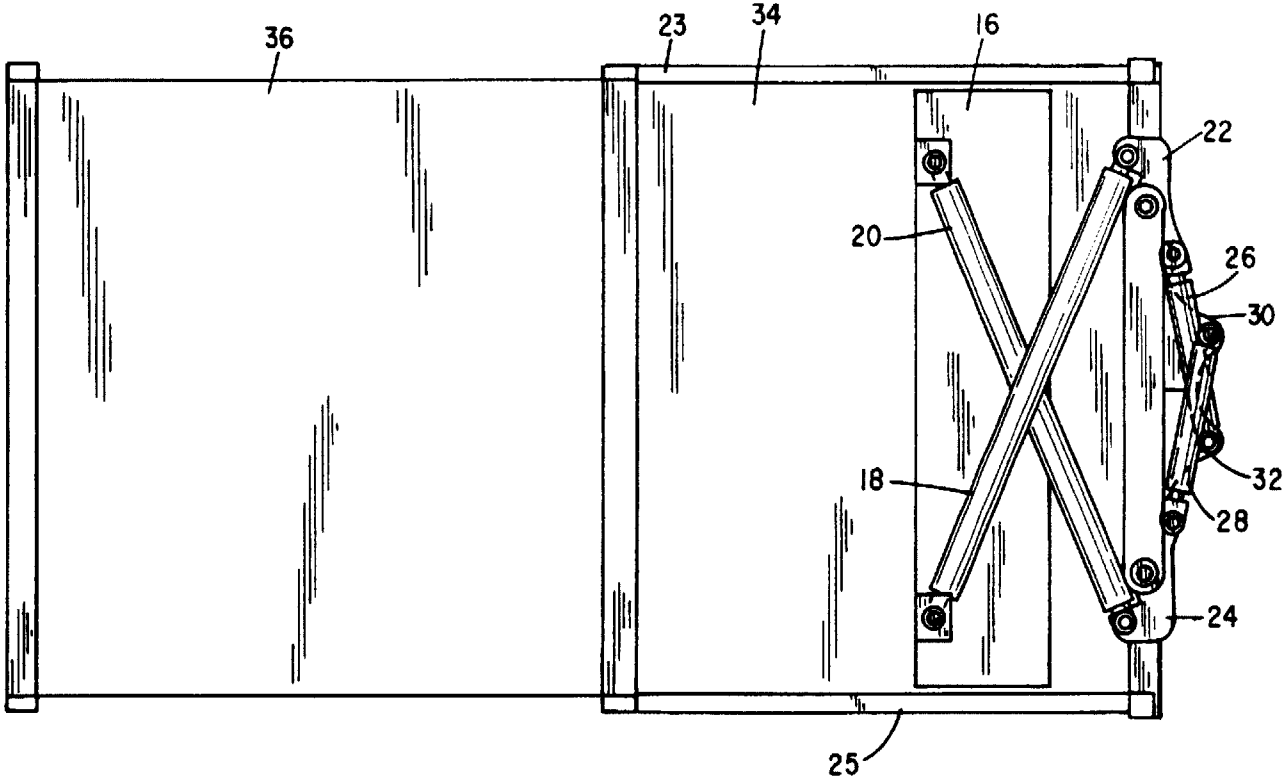
FIG. 9 is a top fragmentary plan view of an alternate embodiment of the packing and ejecting mechanism, wherein the packing and ejecting cylinders are in their stowed position.
Figure 10:
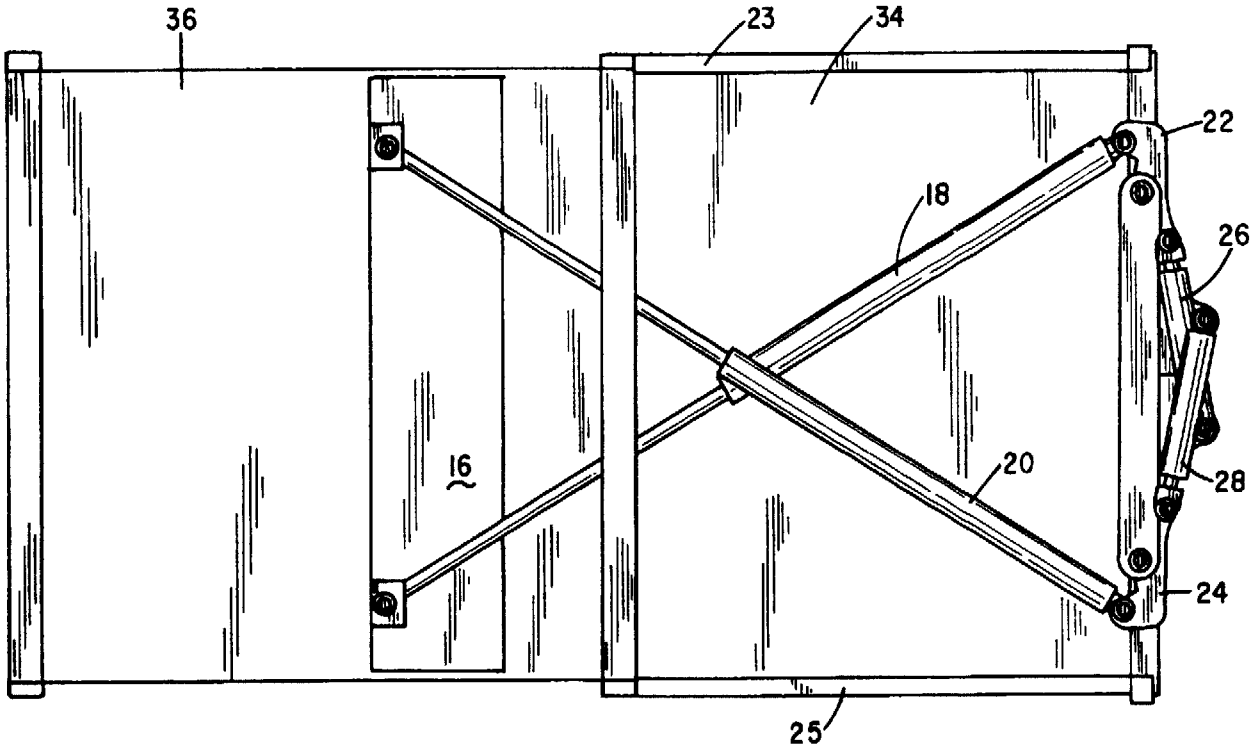
FIG. 10 is a top fragmentary plan view of the embodiment shown in FIG. 9, wherein the ejecting cylinders are in their stowed position and the packing cylinders are fully extended.
Figure 11:
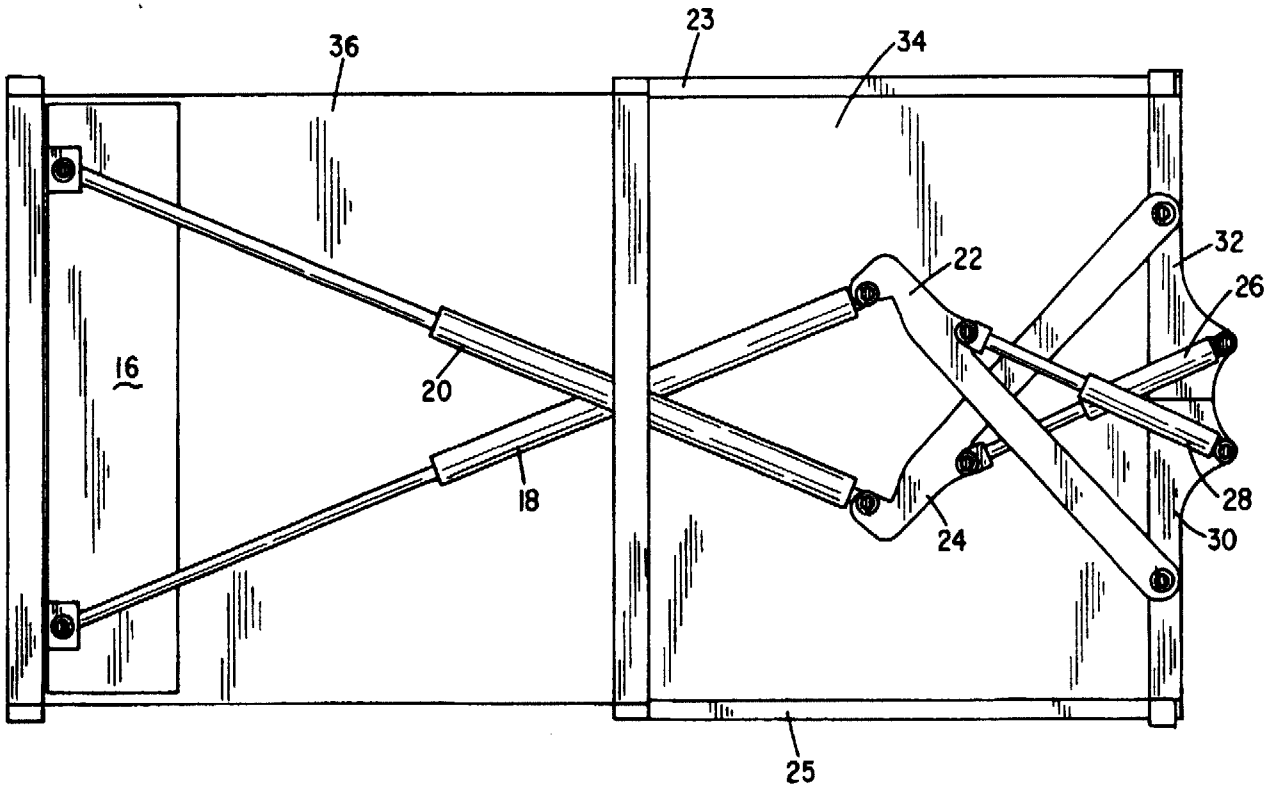
FIG. 11 is a top fragmentary plan view of the embodiment shown in FIG. 9 in the eject mode, wherein the packing cylinders and the ejecting cylinders are both in their fully extended position.

In an alternate embodiment shown in FIGS. 9–11, the base member 30 and 32 of each packing and ejecting mechanism 14 may be positioned in the forward end of the charging hopper 34 at a distance from the sidewalls 23 and 25 and centered between the two sidewalls of the charging hopper 34. When the packing cylinders 18 and 20 are fully extended, the cylinders 18 and 20 remain crossed (see FIG. 10). Likewise, when the ejecting cylinders 26 and 28 are fully extended, the ejecting cylinders 26 and 28 remain crossed (see FIG. 11). In this arrangement, the packer panel 16 may be withdrawn even closer to the forward end of the charging hopper 34, because base members 30 and 32 are positionable further forward in the charging hopper 34, thereby further decreasing the relative amount of space required to stow the packer panel 16.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A mechanized, self-containing vehicle mounted handling system for packing and ejecting refuse comprising:

(a) vehicle chassis for supporting a truck body;

(b) a rear-discharging refuse storage body, said storage body defining a closed hollow storage compartment;

(c) a charging hopper having sidewalls and a floor and defining a refuse material receiving compartment forward of said refuse storage body and open thereto; and (d) a packing and ejecting mechanism for handling refuse deposited in said material receiving compartment of said charging hopper, said mechanism comprising:

(1) a transversely disposed packer panel having a material pushing face positioned within said charging hopper and linearly displaceable parallel to the length of the vehicle between stowed and ejecting positions for respectively receiving materials, packing materials into the storage body and ejecting materials from the rear of the storage body;

(2) a pair of linkage members each having a free end and a fixed end, wherein the fixed end is pivotally attached to a base member toward the front of the charging hopper at a location behind the pushing face of the packer panel;

(3) a pair of packing cylinders each having a first end pivotally attached to the free end of an associated linkage member and a second end pivotally attached to the packer panel behind the pusher face thereof for linearly reciprocally displacing the packer panel through a first longitudinal portion of the storage body between a stowed and a packing position; and (4) a pair of ejecting cylinders each having a first end pivotally attached to the base member of the charging hopper offset a distance from the attachment location of a corresponding linkage member and a second end pivotally attached to the linkage member at a point closer to the free end thereof whereby extension and retraction of the ejecting cylinders pivots said linkage members, and together with the extension of the packing cylinders, displaces the packer panel reciprocally through the remainder of the storage body.

2. The apparatus of claim 1 wherein the packing cylinders are vertically offset and fold when said packing and said ejecting cylinders are retracted to form an X pattern when in the stowed position.

3. The apparatus of claim 1 wherein the ejecting cylinders are vertically offset and fold when said packing and said ejecting cylinders are retracted to form an X pattern when in the stowed position.

4. The apparatus of claim 1 wherein both the packing and ejecting cylinders are vertically offset and fold when said packing and said ejecting cylinders are retracted to form an X pattern when in the stowed position.

5. The apparatus of claim 4 further including a follower panel attached for a forward side of said packer panel.

6. The apparatus of claim 1 further including a follower panel attached for a forward side of said packer panel.

7. The apparatus of claim 1 wherein each base member is positioned proximate a forward edge portion of said charging hopper.

8. The apparatus of claim 1 wherein each base member is positioned in the charging hopper proximate of forward corner of the charging hopper.

9. The apparatus of claim 1 wherein each base member is positioned in the charging hopper proximate a forward edge of the charging hopper and spaced a distance between each sidewall of the charging hopper.

* * * * *